US008925511B2

(12) United States Patent
Allig et al.

(10) Patent No.: US 8,925,511 B2
(45) Date of Patent: Jan. 6, 2015

(54) INTERNAL COMBUSTION ENGINE PISTON WITH COOLING CHANNEL SAID PISTON COMPRISING A SEALING ELEMENT SEALING THE COOLING CHANNEL

(75) Inventors: Franz-Peter Allig, Bessenbach (DE); Wolfgang Köhler, Massenbachhausen (DE); Matthias Laqua, Bad Wimpfen (DE)

(73) Assignee: KS Kolbenschmidt GmbH, Neckarsulm (DE)

( * ) Notice: Subject to any disclaimer, the term of this patent is extended or adjusted under 35 U.S.C. 154(b) by 0 days.

(21) Appl. No.: 13/127,540

(22) PCT Filed: Sep. 15, 2009

(86) PCT No.: PCT/EP2009/006671

§ 371 (c)(1),
(2), (4) Date: Jul. 19, 2011

(87) PCT Pub. No.: WO2010/051878

PCT Pub. Date: May 14, 2010

(65) Prior Publication Data

US 2011/0265744 A1 Nov. 3, 2011

(30) Foreign Application Priority Data

Nov. 4, 2008 (DE) ..... 10 2008 055 848

(51) Int. Cl.
*F02F 3/22* (2006.01)

(52) U.S. Cl.
USPC ..... 123/193.6; 123/41.35

(58) Field of Classification Search
USPC ..... 123/193.6, 41.35, 41.38
See application file for complete search history.

(56) References Cited

U.S. PATENT DOCUMENTS 5,144,923 A * 9/1992 Leites et al. ..... 123/193.6
6,155,157 A 12/2000 Jarrett
6,202,619 B1 * 3/2001 Keller et al. ..... 123/193.6
6,659,062 B1 * 12/2003 Issler ..... 123/193.6

(Continued)

FOREIGN PATENT DOCUMENTS

DE 3906582 C1 4/1990
DE 10013395 C1 8/2001

(Continued)

OTHER PUBLICATIONS

International Search Report for PCTEP2009002536 Dated Mar. 8, 2009.
International Search Report for PCTEP2009006671 Dated Nov. 23, 2009.

*Primary Examiner* — Marguerite McMahon
(74) *Attorney, Agent, or Firm* — Young Basile, P.C.

(57) ABSTRACT

A cooling channel piston has a radially circumferential cooling channel located behind a ring field. The cooling channel piston is forged from a steel material and the cooling channel is worked in by machining between an upper part below the ring field and a lower part above the piston bosses and the piston skirts. The cooling channel extends behind the ring field in the direction of an upper face of the upper part, it being provided that the cooling channel piston has above its piston bosses and piston skirts an outwardly oriented support region. A closing element, which closes the cooling channel after the production thereof, is fastened between the lower edge of the ring field and the support region.

17 Claims, 8 Drawing Sheets

(56) References Cited

U.S. PATENT DOCUMENTS

| | | | | |
|---|---|---|---|---|
| 6,957,638 | B2 * | 10/2005 | Scharp | 123/193.6 |
| 7,387,100 | B2 * | 6/2008 | Fiedler et al. | 123/193.6 |
| 7,415,959 | B2 * | 8/2008 | Scharp | 123/193.6 |
| 7,934,482 | B2 * | 5/2011 | Messmer | 123/193.6 |
| 8,146,560 | B2 * | 4/2012 | Scharp et al. | 123/193.6 |
| 2004/0016531 | A1 | 1/2004 | Gerner | |
| 2004/0168319 | A1 | 9/2004 | Mielke | |
| 2005/0072394 | A1 * | 4/2005 | Gabriel et al. | 123/193.6 |
| 2006/0000087 | A1 | 1/2006 | Huang | |
| 2008/0121204 | A1 * | 5/2008 | Scharp | 123/193.6 |
| 2008/0229923 | A1 | 9/2008 | Gniesmer et al. | |
| 2008/0245229 | A1 | 10/2008 | Buschbeck et al. | |
| 2008/0245231 | A1 | 10/2008 | Gniesmer et al. | |
| 2009/0007880 | A1 * | 1/2009 | Messmer | 123/193.6 |
| 2009/0159037 | A1 * | 6/2009 | Messmer | 123/193.6 |
| 2009/0241769 | A1 | 10/2009 | Feeser | |
| 2009/0250033 | A1 * | 10/2009 | Scharp | 123/193.6 |
| 2010/0037765 | A1 | 2/2010 | Gniesmer et al. | |
| 2010/0101527 | A1 | 4/2010 | Gniesmer | |
| 2010/0275873 | A1 | 11/2010 | Gniesmer et al. | |
| 2010/0299922 | A1 | 12/2010 | Gniesmer et al. | |

FOREIGN PATENT DOCUMENTS

| | | | |
|---|---|---|---|
| DE | 10326456 | A1 | 12/2004 |
| DE | 10346819 | A1 | 4/2005 |
| DE | 10346819 | A1 | 4/2005 |
| DE | 10346822 | A1 | 4/2005 |
| DE | 102005037175 | A2 | 2/2007 |
| DE | 102006045728 | A1 | 4/2008 |
| GB | 1096826 | A | 12/1967 |
| JP | 2005090448 | A | 4/2005 |
| JP | 2006299979 | A | 1/2011 |
| SU | 1283432 | A1 | 1/1987 |
| WO | WO0004286 | A1 | 1/2000 |
| WO | 2007143968 | A | 12/2007 |

* cited by examiner

INTERNAL COMBUSTION ENGINE PISTON WITH COOLING CHANNEL SAID PISTON COMPRISING A SEALING ELEMENT SEALING THE COOLING CHANNEL

BACKGROUND

The invention relates to a cooling channel piston which has a radially circumferential cooling channel located behind a ring field.

A generic cooling channel piston and a method for producing same is known from DE 100 13 395 C1. In this cooling channel piston a piston blank is forged from a steel material, the forging process having the advantage that a material microstructure with especially high strength properties is produced. This is necessary to meet the strength demands placed on cooling channel pistons when used in modern internal combustion engines. These strength demands result, in particular, from the ever-increasing combustion pressures, combustion temperatures and injection pressures of the fuel injected into the cylinder chamber of the internal combustion engine.

After the piston blank has been forged and piston skirts and piston bosses have already been forged integrally therewith, the cooling channel is cut between an upper part and a lower part of the piston by machining in a number of steps. In the process disclosed in DE 100 13 395 C1 it is especially advantageous that the cooling channel is cut in a particular manner, so that the cooling channel extends behind the ring field in the direction of an upper face of the upper part of the cooling channel piston, in order, firstly, to increase the volume of the cooling channel and, secondly, to keep the overall height of the piston as low as possible. In order to implement the function of the cooling channel, namely the circulation of a coolant such as engine oil in the cooling channel, it is also necessary for the cooling channel to be closed by a closing element. Owing to the design of the cooling channel piston of DE 100 13 395 C1, it is possible to close the closing element only in a plane parallel to a plane of the upper face of the piston crown. This means, however, that the gap cut radially between the lower part and the upper part of the cooling channel piston remains and a weakening of the piston in operation in the cylinder chamber of the internal combustion engine results.

It would be desirable to make available a cooling channel piston which is improved with respect to the cooling channel piston of the prior art and which, in particular, meets the necessary strength demands during its operation in the cylinder chamber of the internal combustion engine.

SUMMARY

A cooling channel piston with an outwardly-facing support region above its piston bosses and piston skirts, has a closing element arranged and fastened between the lower edge of the ring field and the support region (viewed in the direction of the piston stroke axis), which closing element closes the cooling channel after the production thereof. It is thereby achieved, on the one hand, that a large effective cooling channel volume is obtained (especially if the cooling channel has been produced using the method according to DE 100 13 395 C1) and, on the other hand, that the necessary strength is achieved because, as a result of the arrangement of the closing element, the upper part of the cooling channel piston, which is especially highly stressed on account of the combustion pressures, can be supported on the piston skirts via the closing element. To this end the closing element is oriented parallel to the piston stroke axis (and not transversely thereto, as in DE 100 13 395 C1).

In one aspect, the closing element is made from a heat-resistant plastic material, in particular a plastic based on silicon. The closing element, based either on plastic material or on steel material, may have a unitary or multi-part configuration. This leads to especially high stiffness and simple installation. A closing element made of heat-resistant plastic material has, in addition, the advantage that, as a result of the stability of the plastic material, not only is once-only closure possible but, after a given operating duration of the piston and its removal from the internal combustion engine, the plastic closing ring can be removed in order to inspect the cooling channel. The cooling channel can then be closed again by a new closing element, or even with the closing element previously used, the last-mentioned possibility advantageously entailing a cost reduction.

In another aspect, the closing element is releasably or non-releasably connected to the lower edge of the ring field and/or to the support region. This releasable connection has the advantage that the closing element can be removed and the cooling channel can be closed again with the same closing element or a different one. The non-releasable connection has, in addition, the advantage that stiffness is improved since the highly-stressed piston crown can be supported in operation on the piston skirts. The non-releasable connection may be effected punctually, in partial regions in a radially circumferential manner, or over the full circumference. The non-releasable connection of the closing element with its upper edges in the direction of the ring field and in the direction of the support region is especially advantageous, and further advantageous if connected over its entire radial circumference. In the case of a closing element made of a metal material, the non-releasable connection may be effected, for example, by soldering or welding, while a closing element made of a plastic material may be bonded. Bonding is also an advantageous alternative to soldering or welding in the case of a closing element made of a metal material. Alternatively, it is possible that the closing element is connected releasably to the lower edge of the ring field and to the support region by a press fit, in which case the closing element especially advantageously has at least one shoulder on its upper and/or lower edge while the support region likewise has a shoulder corresponding to the at least one shoulder of the closing element. The respective shoulder may also have a multi-step configuration, so that the closing element is releasably fastened to the lower edge of the ring field and/or to the support region, for example by means of a tongue and groove connection.

In another aspect, the closing element has at least one opening, especially advantageously a plurality of openings distributed on the radial circumference. In this case, the opening or openings is/are selected in such a manner that a certain proportion of the circulating engine oil leaves the cooling channel and serves to lubricate the piston skirt against the cylinder inner wall of the internal combustion engine. For this purpose, the at least one opening or the plurality of openings is/are provided in a region in the closing element above the piston skirts of the cooling channel piston.

In yet another aspect, at least one transverse connection is provided between the cooling channel and a piston inner region of the cooling channel piston. Via this at least one transverse connection, especially advantageously on the basis of a plurality of transverse connections, it is possible that the engine oil which is injected into the piston inner region enters the cooling channel via the at least one transverse connection, circulates therein and exits via the at least one further transverse connection and thus dissipates heat in order to cool the piston crown.

BRIEF DESCRIPTION OF THE DRAWING

The invention is explained below with reference to different sections through a cooling channel piston and with reference to FIGS. 1 to 5 in which.

DETAILED DESCRIPTION

Figure 1:
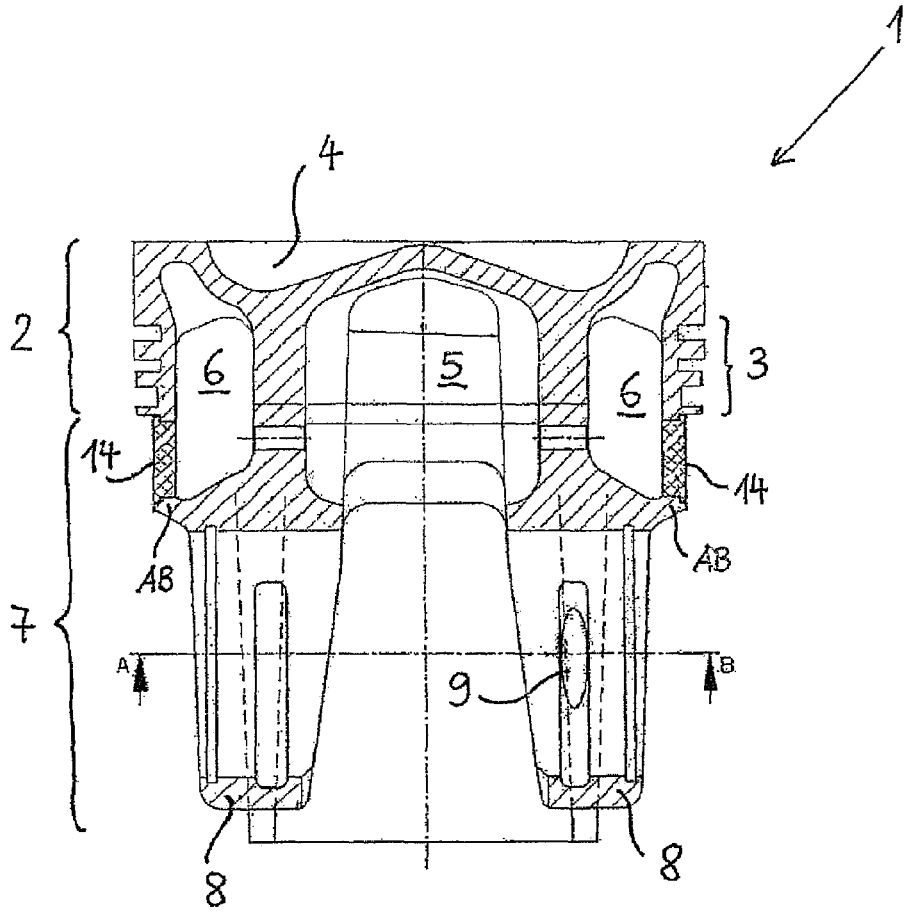
FIG. 1 is a cross-sectional view of a cooling channel piston.
Figure 2:
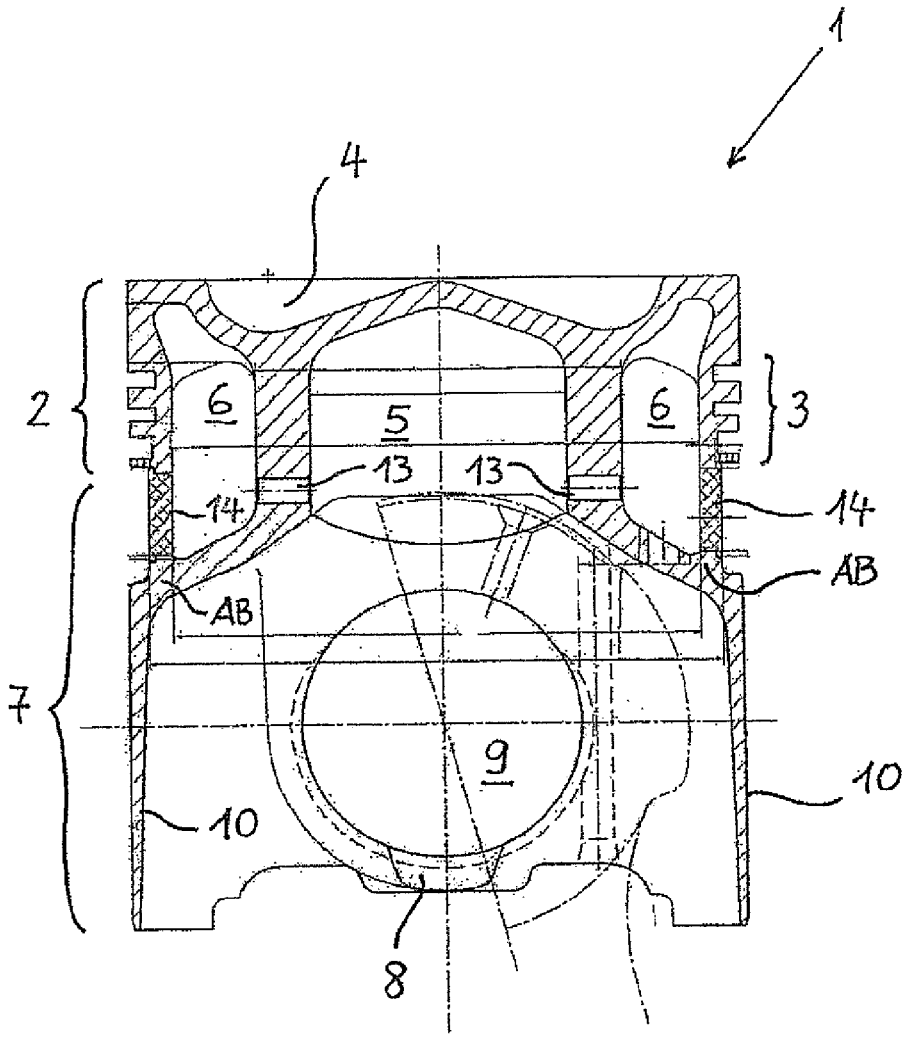
FIG. 2 is a cross-sectional view rotated 90° from FIG. 1.
Figure 3:
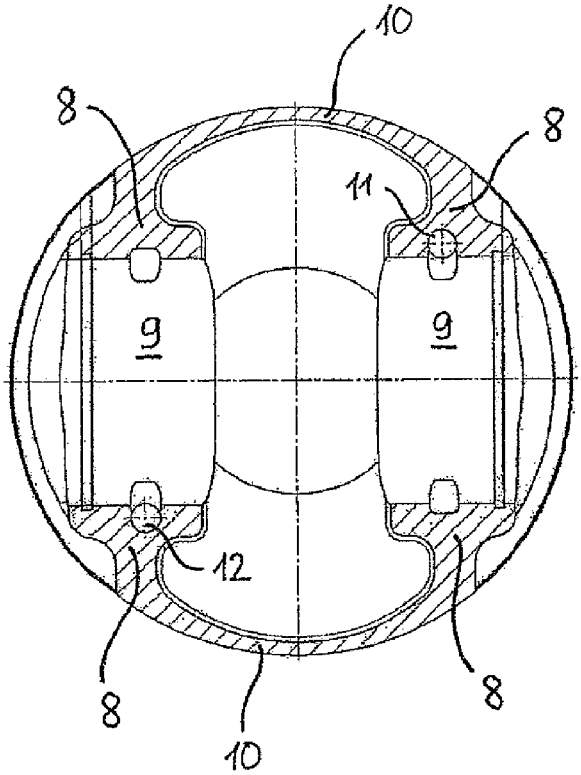
FIG. 3 is a cross-sectional view generally taken along line A & B in FIG. 1.
Figure 4A:
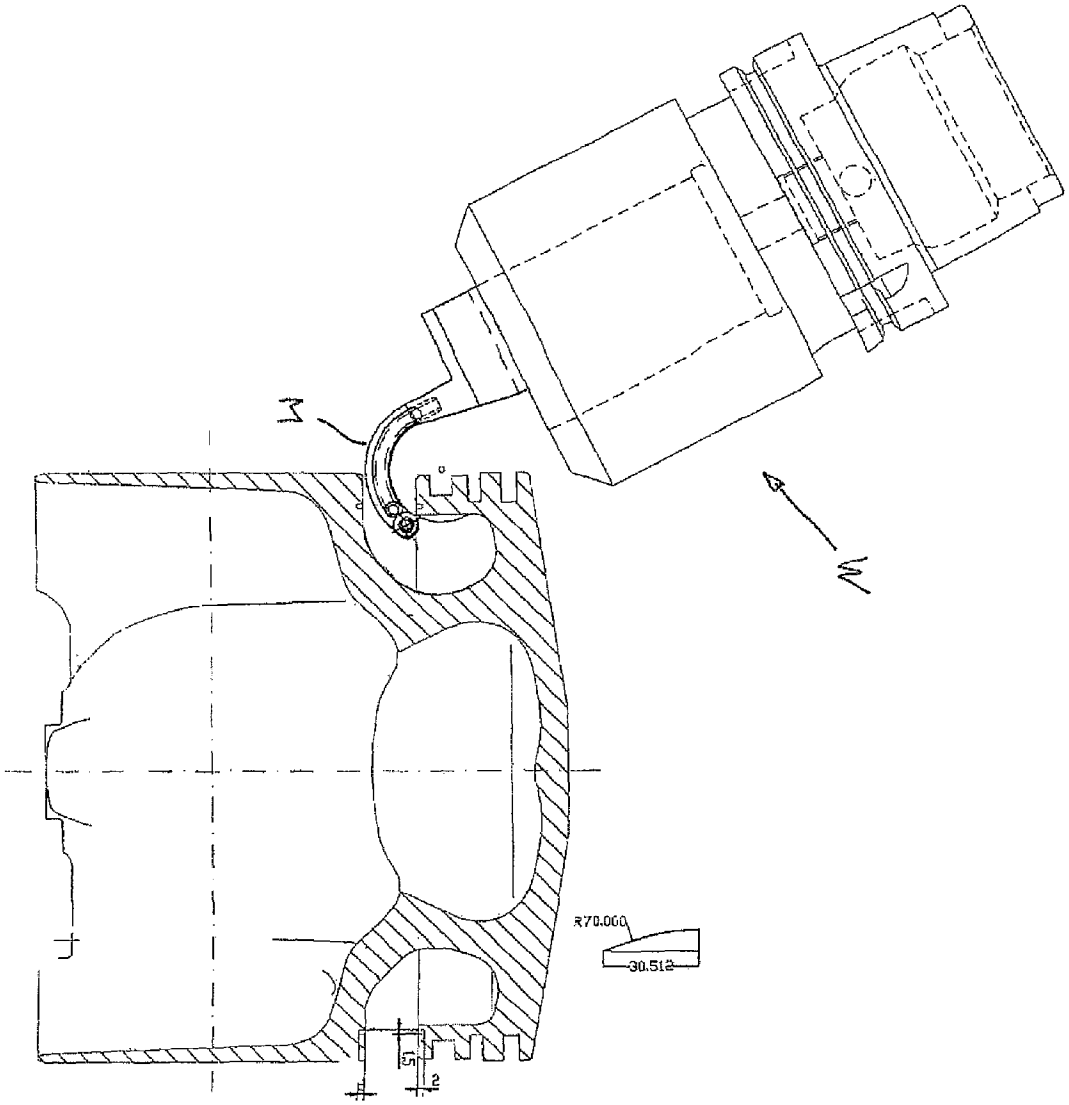
FIG. 4A is a cross-sectional view, similar to FIG. 2 showing the use of a tool and cutter to firm the cooling channel.
Figure 4B:
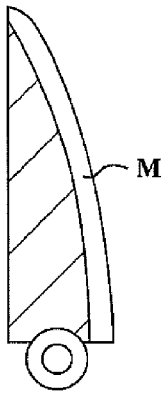
FIG. 4B is a side-elevational view of the tool.
Figure 4C:
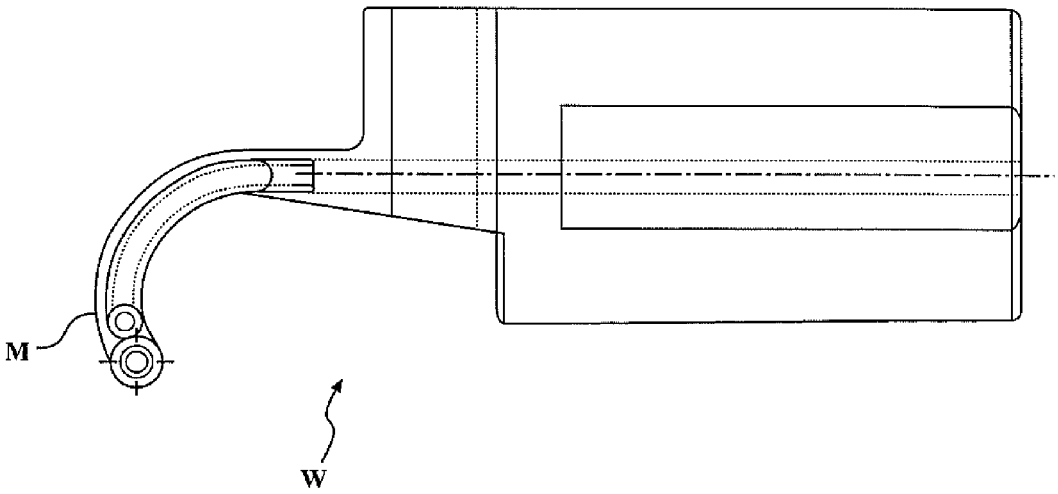
FIG. 4C is a elevational view of the cutter.

In FIGS. 1 to 3, a cooling channel piston 1 formed in one piece from a steel material having an upper part 2 with a ring field 3 denoted by reference number 1. A combustion chamber recess 4 is present on the upper face of the upper part 2, but is optional. Reference number 5 denotes a piston inner region, with a cooling channel extending in a radially circumferential manner behind the ring field 3 and the piston inner region 5.

The cooling channel piston 1 further comprises a lower part 7 which includes piston bosses 8 with pin bores 9 and piston skirts 10. In the cooling channel piston 1 represented in FIGS. 1 to 3, the piston skirts 10 are present only in partial regions of the radial circumference, while the piston bosses 8 are set back with respect to the external diameter of the cooling channel piston 1. However, the cooling channel piston 1 is not restricted to constructions in which the piston skirts 10 are formed cylindrically in a radially circumferential manner and form the outer region of the lower part 7.

It is possible that at least one inlet opening 11 in the direction of the cooling channel 6, as well as an outlet opening 12, for the engine oil which is to be injected into the cooling channel 6, are present in the region of the piston bosses 8. Alternatively or additionally to the openings 11, 12, at least one transverse connection 13, preferably two transverse connections (one outlet and one inlet for the engine oil), may also be present between the piston inner region 5 and the cooling channel 6.

Reference Symbol AB denotes the outwardly oriented support region for a closing element 14, the support region AB being provided above the piston bosses 8 (FIG. 1) and above the piston skirts 10 (FIG. 3). The closing element 14, which is preferably rectangular and elongated in cross section, is oriented parallel to the piston stroke axis and is arranged and fastened between the lower edge of the ring field 3 and the upper edge of the support region AB. In one aspect of the cooling channel piston 1 shown in FIGS. 1 to 3, the closing element 14 is implemented in at least two parts so that it can be arranged and fastened in the region between ring field 3 and the support region AB In a first aspect, the closing element 14 may be connected non-releasably, for example, by soldering, welding, bonding or the like, to the support region AB and/or to the lower edge of the ring field 3. In a further alternative, the closing element 14 is arranged and fastened on the cooling channel piston 1 by a press fit. For this purpose, the closing element 14 has a single-step shoulder on its upper and lower edge, the support region AB likewise having a shoulder corresponding to the shoulders of the closing element 14. Multi-step shoulders or tongue and groove connections between closing element 14 and lower edge of ring field 3 on one side and upper edge of support region AB on the other side are also possible.

Analogously to the configurations of the cooling channel piston 1 as shown and described in FIGS. 1 to 3, FIGS. 4A, 4B and 4C and 5A, 5B, 5C show further design details and the implementation of the method for forming the cooling channel 6 in the upper part 2 of the cooling channel piston 1. As in the cooling channel piston 1 according to FIGS. 1 to 3, a radially circumferential opening extending between the support region AB and the circumferential lower edge of the ring field 3 is cut where the closing element 14 is subsequently arranged and fastened. A tool W which is fitted with an arcuate or sickle-shaped cutter M is used for this purpose. This cutter M of the tool W is introduced into the opening and is moved as a result either of a radial movement of the tool W in the case of a fixed cooling channel piston 1 or, in the case of a fixed tool W, of a movement of the cooling channel piston 1 relative thereto. As a result of the radial movement either of the cutter M or of the cooling channel piston 1, the cooling channel 6 can be worked in a stepwise manner, the cross section of the cooling channel 6 formed the cross-sectional form shown in FIG. 4A with an approximately kidney shape. The advantage of the illustrated cross section of the cooling channel 6, which is approximately kidney-shaped, is an improved distribution of stress in the upper part 2 of the cooling channel piston 1, while at the same time, the weight of the cooling channel piston 1 as a whole is reduced. The improved distribution of stress results from the relatively large radii of the cross section of the cooling channel 6 produced by the arcuate or sickle-shaped cutter M.

Figure 5A:
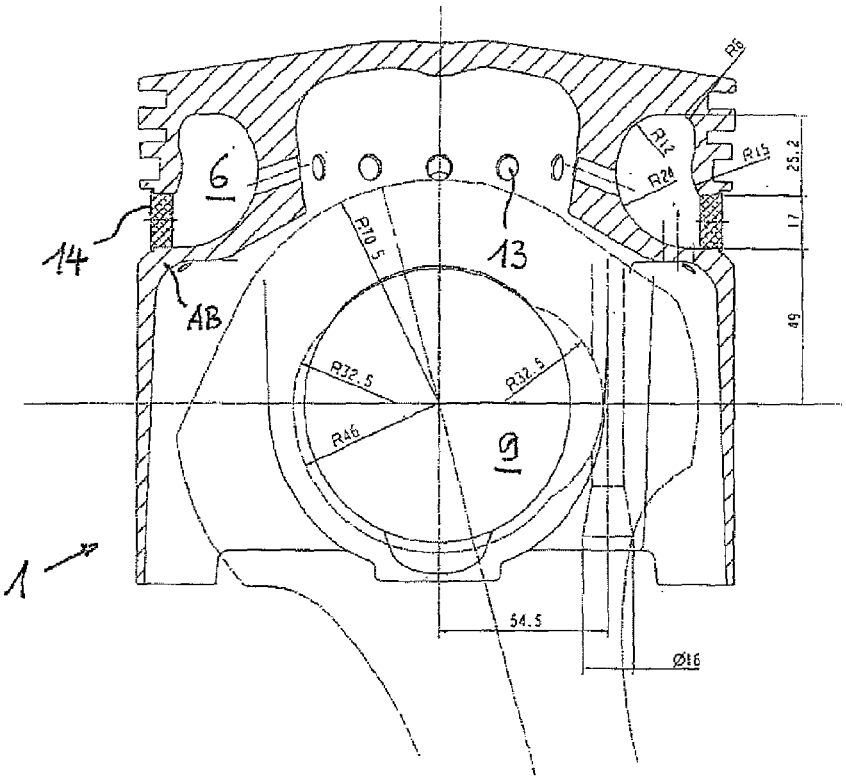
FIG. 5A is a cross-sectional view, similar to FIG. 1, showing the finished machined piston.
Figure 5B:
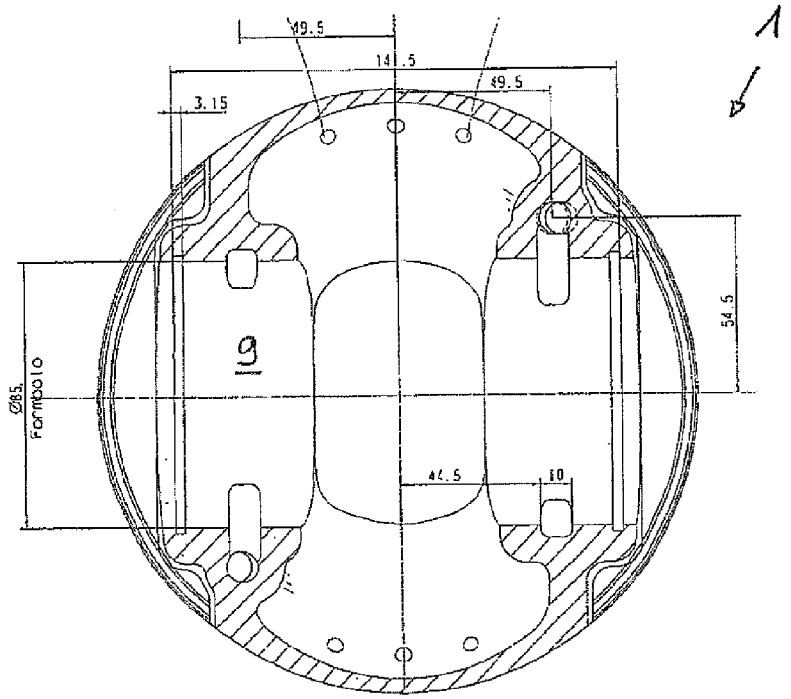
FIG. 5B is a cross-sectional view, similar to FIG. 2, showing the finished machined piston.
Figure 5C:
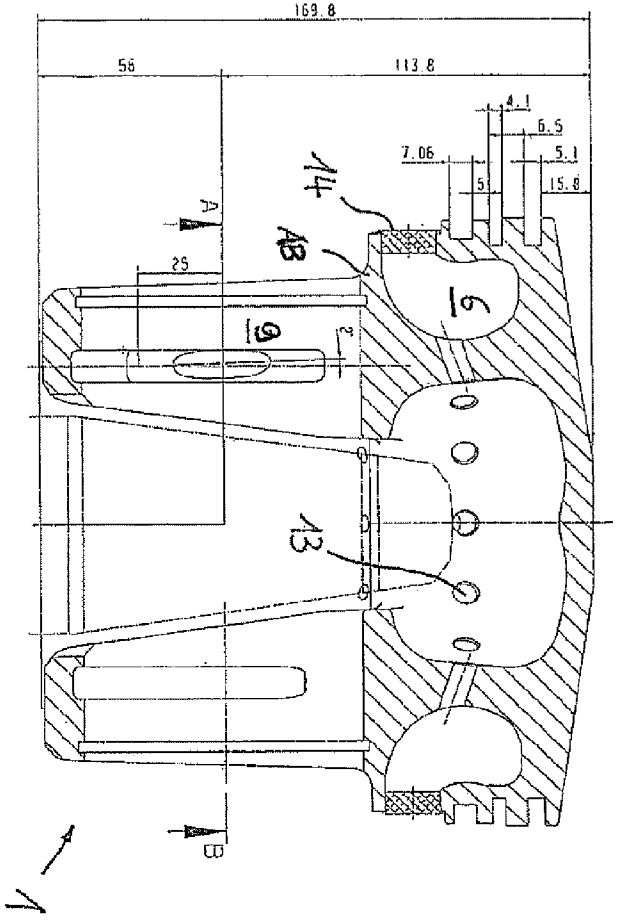
FIG. 5C is a cross-sectional view, similar to FIG. 3, showing the finished machined piston.

FIGS. 5A, 5B, and 5C show different views of the fully machined and finished cooling channel piston 1; it can be seen that the finished cooling channel 6 in the upper part 2 is closed with the closing element 14. This closing element 14 is supported between the support region AB above the piston skirts 10 and the radially circumferential lower edge of the ring field 3, as previously shown in FIGS. 1 to 3. In addition, a plurality of transverse connections 13 are present in a star-shaped formation between the piston inner region 5 and the cooling channel 6.

The invention claimed is:

1. A cooling channel piston comprising:

a one-piece piston having an upper part with an upper face, a ring field in the upper part, and piston bosses and piston skirts;

a radially circumferential cooling channel having a kidney-like shape located behind the ring field, the cooling channel having an upper part behind the ring field and a lower part above the piston bosses and the piston skirts, the cooling channel extending behind the ring field in a direction of the upper face of the upper part of the piston;

the cooling channel piston having an outwardly oriented support region above the piston bosses and the piston skirts;

a closing element, which closes the cooling channel after the production thereof, fastened between a lower edge of the ring field and the support region; and the lower edge of the ring field and the portion of the support region on which the closing element is fastened being co-linearly disposed in a plane substantially parallel to a longitudinal stroke axis of the piston, such that the entire closing element is disposed substantially parallel to a longitudinal stroke axis of the piston.

2. The cooling channel piston according to claim 1, characterized in that the closing element is formed of a heat-resistant plastic material.

3. The cooling channel piston according to claim 1, characterized in that the closing element has one of a unitary and a multi-part configuration.

4. The cooling channel piston according to claim 1, characterized in that the closing element has at least one shoulder on one of an upper edge and a lower edge, the support region having a shoulder corresponding to the at least one shoulder of the closing element.

5. The cooling channel piston according to claim 4, characterized in that the closing element is one of releasably and non-releasably connected to one of the lower edge of the ring field and to the support region.

6. The cooling channel piston according to claim 1, characterized in that the closing element has at least one opening.

7. The cooling channel piston according to claim 1, characterized in that at least one transverse connection is provided between the cooling channel and a piston inner region of the cooling channel piston.

8. The cooling channel piston according to claim 1, characterized in that a plurality of transverse connections are provided between the cooling channel and a piston inner region of the cooling channel piston.

9. The cooling channel piston according to claim 1 characterized in that the closing element has a plurality of openings.

10. The cooling channel piston according to claim 2, characterized in that the closing element has one of a unitary and a multi-part configuration.

11. The cooling channel piston according to claim 4, characterized in that the closing element is one of releasably and non-releasably connected to one of the lower edge of the ring field and to the support region.

12. The cooling channel piston according to claim 3, characterized in that the closing element has at least one opening.

13. The cooling channel piston according to claim 4, characterized in that the closing element has at least one opening.

14. The cooling channel piston according to claim 11, characterized in that the closing element has at least one opening.

15. The cooling channel piston according to claim 4, characterized in that at least one transverse connection is provided between the cooling channel and a piston inner region of the cooling channel piston.

16. The cooling channel piston according to claim 5, characterized in that at least one transverse connection is provided between the cooling channel and a piston inner region of the cooling channel piston.

17. The cooling channel piston according to claim 6, characterized in that at least one transverse connection is provided between the cooling channel and a piston inner region of the cooling channel piston.

* * * * *